US010752850B2

(12) United States Patent
Li et al.

(10) Patent No.: US 10,752,850 B2
(45) Date of Patent: Aug. 25, 2020

(54) COMBINED HYDROGENATION PROCESS METHOD FOR PRODUCING HIGH-QUALITY FUEL BY MEDIUM-LOW-TEMPERATURE COAL TAR

(71) Applicants: Inner Mongolia ShengYuan Technology Co. Ltd., Ordos, Inner Mongolia Autonomous Region (CN); China University of Petroleum (East China), Qingdao, Shandong (CN)

(72) Inventors: Chuan Li, Shandong (CN); Wen'an Deng, Shandong (CN); Jinlin Wang, Hebei (CN); Liang Feng, Ordos (CN); Shufeng Li, Shandong (CN); Feng Du, Beijing (CN)

(73) Assignees: Inner Mongolia ShengYuan Technology Co. Ltd., Ordos (CN); China University of Petroleum (East China), Qingdao (CN)

( * ) Notice: Subject to any disclaimer, the term of this patent is extended or adjusted under 35 U.S.C. 154(b) by 0 days.

(21) Appl. No.: 16/236,379

(22) Filed: Dec. 29, 2018

(65) Prior Publication Data

US 2019/0345399 A1 Nov. 14, 2019

(30) Foreign Application Priority Data

May 11, 2018 (CN) ..... 2018 1 0448892

(51) Int. Cl.
*C10G 67/14* (2006.01)
*C10G 1/00* (2006.01)
(Continued)

(52) U.S. Cl.
CPC ..... *C10G 67/14* (2013.01); *C10G 1/002* (2013.01); *C10G 1/06* (2013.01); *C10L 1/026* (2013.01);
(Continued)

(58) Field of Classification Search
CPC ..... C10G 47/26; C10G 65/00; C10G 65/12; C10G 65/14; C10G 67/14; C10G 1/002;
(Continued)

(56) References Cited

U.S. PATENT DOCUMENTS 5,286,692 A * 2/1994 Zhao ..... C10G 47/20 208/111.01
2018/0230388 A1* 8/2018 Li ..... C10G 67/02
2019/0201882 A1* 7/2019 Liu ..... C10G 65/12

FOREIGN PATENT DOCUMENTS

CN 101538482 A 9/2009
CN 102465033 A 5/2012

* cited by examiner

*Primary Examiner* — Brian A McCaig

(57) ABSTRACT

A combined hydrogenation process method for producing high-quality fuel by medium-low-temperature coal tar, wherein a medium-low-temperature coal tar is fractionated to obtain a final product through a thermal hydrocracking unit, a first atmospheric fractionation unit, a hydro-refining, unit, a vacuum fractionation unit, a diesel and wax oil hydro-upgrading unit, a wax oil hydro-cracking unit, a gasoline and diesel precious metal hydrogenation unit and a fourth atmospheric fractionation unit. The present invention can effectively improve the quality of naphtha, aviation kerosene and diesel products, and produce high-end products with high yield and high value, and thus it has a great prospect of promotion and application.

9 Claims, 1 Drawing Sheet

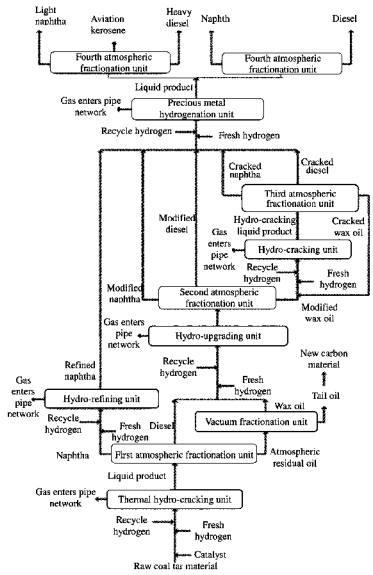

(51) Int. Cl.

| | |
|---|---|
| ***C10G 1/06*** | (2006.01) |
| ***C10L 1/02*** | (2006.01) |
| *C10G 1/02* | (2006.01) |

(52) U.S. Cl.
CPC ... *C10G 2300/205* (2013.01); *C10G 2400/04* (2013.01); *C10L 2200/0446* (2013.01); *C10L 2270/026* (2013.01); *C10L 2290/02* (2013.01); *C10L 2290/06* (2013.01); *C10L 2290/24* (2013.01); *C10L 2290/544* (2013.01)

(58) Field of Classification Search
CPC ... C10G 1/06; C10L 1/02; C10L 1/026; C10L 1/04
See application file for complete search history.

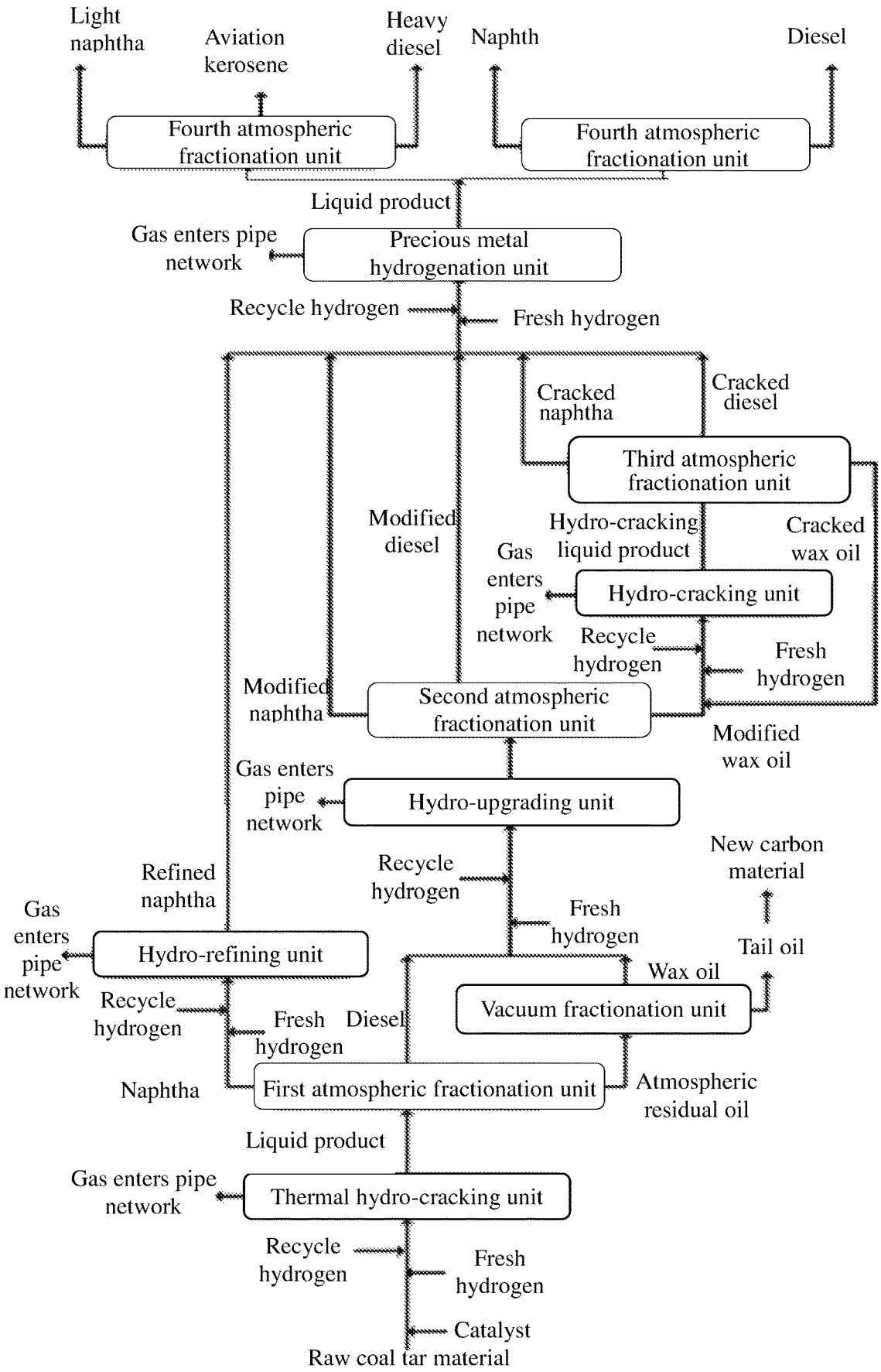
Light naphtha
Aviation kerosene
Heavy diesel
Naphth
Diesel
Fourth atmospheric fractionation unit
Fourth atmospheric fractionation unit
Liquid product
Gas enters pipe network
Precious metal hydrogenation unit
Recycle hydrogen
Fresh hydrogen
Cracked naphtha
Cracked diesel
Third atmospheric fractionation unit
Modified diesel
Hydro-cracking liquid product
Cracked wax oil
Gas enters pipe network
Hydro-cracking unit
Recycle hydrogen
Fresh hydrogen
Modified naphtha
Second atmospheric fractionation unit
Modified wax oil
Gas enters pipe network
Hydro-upgrading unit
New carbon material
Refined naphtha
Recycle hydrogen
Fresh hydrogen
Tail oil
Gas enters pipe network
Hydro-refining unit
Wax oil
Recycle hydrogen
Fresh hydrogen
Diesel
Vacuum fractionation unit
Naphtha
First atmospheric fractionation unit
Atmospheric residual oil
Liquid product
Gas enters pipe network
Thermal hydro-cracking unit
Recycle hydrogen
Fresh hydrogen
Catalyst
Raw coal tar material

COMBINED HYDROGENATION PROCESS METHOD FOR PRODUCING HIGH-QUALITY FUEL BY MEDIUM-LOW-TEMPERATURE COAL TAR

CROSS REFERENCE TO RELATED APPLICATIONS

The present application claims the benefit of Chinese Patent Application No. 201810448892.X filed on May 11, 2018, the contents of which are hereby incorporated by reference.

TECHNICAL FIELD

The present invention relates to a combined hydrogenation process method for producing high-quality fuel by medium-low-temperature coal tar, and it belongs to the field of inferior heavy oil processing technology.

BACKGROUND

Medium-low-temperature coal tar mostly results from low-rank coal pyrolysis and fixed bed gasification, characterized by a black or brown thick liquid by-product with pungent odour. At present, the total production capacity of medium-low-temperature coal tar in China is about 6 million tons, with a total output of 3.5 million tons. Medium-low-temperature coal tar is mainly distributed in Shaanxi, Inner Mongolia and Xinjiang, and obtained by the coal pyrolysis process. However, a large number of coal-based natural gas plants are stepping into a planning and construction period in China, and the fixed bed pressure gasification technology, as the source of the process, will be widely spread correspondingly; as a result, amount of the associated medium-low-temperature coal tar will increase rapidly in the future. It is estimated that by 2020, the new production capacity of medium-low-temperature coal tar will reach 15 million tons per year. In addition, with the large-scale popularization of clean and efficient utilization technology of low-rank coal in China, it has currently become a common understanding of the industry to improve the utilization value of lignite through low-temperature pyrolysis technology; the production of low-temperature coal tar will also increase. In terms of composition, medium-low-temperature coal tar contains a large number of unstable components such as aromatic hydrocarbons and gums, which are easy to coke during processing. It also contains a large number of mechanical impurities such as metals and pulverized coal particles, which seriously affect the operation cycle of subsequent processing. Compared with high-temperature coal tar, medium-low-temperature coal tar has higher phenol content, which is a component with high economic value. To a certain extent, these characteristics of medium-low-temperature coal tar increase the difficulty of deep processing. Now it is difficult to directly apply mature heavy oil processing schemes, which poses a challenge to the maximization of economic benefit of the utilization mode.

CN 101538482A discloses a medium-low-temperature coal tar processing method, including the following steps: (1) fractionating a medium-low-temperature raw coal tar, and obtaining a light fraction (with a final boiling point lower than 180° C. to −230'C), a phenol oil fraction and a heavy fraction (with an initial boiling point greater than 270'C); (2) dephenolizing the phenol oil fraction obtained from step (1), and obtaining a phenol product and a dephenolized oil; (3) carrying out coking reaction on the dephenolized oil obtained from step (2) and the heavy fraction obtained from step (1), and obtaining coking dry gas, liquefied gas, coking naphtha, coking diesel, coking wax oil and petroleum coke products; (4) mixing at least one of the coking naphtha, coking diesel and coking wax oil obtained from step (3) with the light fraction obtained from step (1) or the dephenolized oil from light fraction dephenolizing, carrying out hydro-refining and hydro-cracking reaction, and obtaining dry gas, liquefied gas, hydrogenated naphtha and hydrogenated diesel products; (5) carrying out catalytic reforming-aromatic extraction on the hydrogenated naphtha obtained from the hydro-cracking process in step (4), and obtaining benzene, toluene, xylene and solvent oil products. CN 1.02465033A discloses a medium-low-temperature coal tar processing method, including the following steps: fractionating a medium-low-temperature coal tar, and obtaining a light fraction and a heavy fraction, the cut point temperature of the light fraction and the heavy fraction being 330-440'C; separating phenolic compounds from the light fraction through acid-base extraction, and obtaining a crude phenol; carrying out preliminary hydro-refining on the light fraction from dephenolizing; heating the effluent from preliminary hydro-refining through a heating furnace, and then carrying out hydro-treatment. The heavy fraction can be used as a modified asphalt, a heavy fuel oil or a coking raw material. These patents have the technical problems such as low utilization ratio of medium-low-temperature coal tar, low product quality and low value.

SUMMARY OF THE INVENTION

In view of this, the present invention aims to provide a combined hydrogenation process technique for producing high-quality fuel by medium-low-temperature coal tar, which can solve the technical problems such as low utilization ratio of medium-low-temperature coal tar, low product quality and low value.

To realize above purpose, the present invention provides the following technical scheme.

A combined hydrogenation process method for producing high-quality fuel by medium-low-temperature coal tar comprises the following steps:

step i, mixing a medium-low-temperature coal tar, a catalyst, a fresh hydrogen and a recycle hydrogen and directly entering a thermal hydrocracking unit; after reaction in the thermal hydrocracking unit, making the resulting gas product enter a pipe network, while liquid product enters a first atmospheric fractionation unit;

step ii, fractionating the liquid product a naphtha, a diesel and an atmospheric residual oil through the first atmospheric fractionation unit;

step iii, mixing the naphtha, the fresh hydrogen and the recycle hydrogen and entering a naphtha hydro-refining unit; after reaction in the naphtha hydro-refining unit, making the gas product enter a pipe network, while the liquid product is a refined naphtha;

step iv, making atmospheric residual oil enter a vacuum fractionation unit, and fractionating atmospheric residual oil into a tail oil and a wax oil through the vacuum fractionation; the tail oil is used to prepare a new carbon material;

step v, mixing the diesel with the wax oil, and then mixing with the fresh hydrogen and the recycle hydrogen, and then entering a diesel and wax oil hydro-upgrading unit; after reaction in the diesel and wax oil hydro-upgrading unit, making the gas product enter a pipe network, while the liquid product enter a second atmospheric fractionation unit, and fractionating the liquid product into a modified naphtha, a modified diesel fraction and a modified wax oil in the second atmospheric fractionation unit;

step vi, mixing the modified wax oil with the cracked wax oil, and then mixing with the fresh hydrogen and the recycle hydrogen, and then entering a wax oil hydro-cracking unit; after reaction in the wax oil hydro-cracking unit, making the gas product enter a pipe network, while the liquid product enters a third atmospheric fractionation unit, and fractionating the liquid product into a cracked naphtha, a cracked diesel fraction and a cracked wax oil fraction in the third atmospheric fractionation unit;

step vii, mixing the refined naphtha with the modified naphtha, the modified diesel, the cracked naphtha and the cracked diesel, and then mixing with the fresh hydrogen and the recycle hydrogen, and then entering a gasoline and diesel precious metal hydrogenation unit; after reaction in the gasoline and diesel precious metal hydrogenation unit, making the gas product enter a pipe network, while the liquid product enters a fourth atmospheric fractionation unit, and fractionating the liquid product in the fourth atmospheric fractionation unit to yield a final product.

Further, a preferred embodiment of the present invention is that: the liquid product is fractionated into a light naphtha product as a high-quality raw material for catalytic reforming, a jet fuel product as a high-density aviation kerosene, and a heavy diesel product as a high-density diesel blend component in the fourth atmospheric fractionation unit.

Further, a preferred embodiment of the present invention is that: the liquid product is fractionated into a naphtha product as a high-quality raw material for catalytic reforming and a diesel product as a high-density low-condensation-point diesel in the fourth atmospheric fractionation unit.

Further, a preferred embodiment of the present invention is that: the catalyst of the thermal hydrocracking unit is a molybdenum-nickel-iron trimetal compound oil soluble catalyst; the mass ratio of the molybdenum-nickel-iron trimetal compound oil soluble catalyst is 1:5:5 to 1:10:10; the thermal hydrocracking unit adopts a thermal hydrocracking reactor that is an empty tube reactor without internal components; the thermal hydrocracking reactor operates under the conditions of reaction pressure 15 to 25 MPa, reaction temperature 410 to 460° C., total feed volume space velocity 0.5 to 2.0 $h^{-1}$, and hydrogen/oil volume ratio 600 to 1400; the total amount of metals in the catalyst is 0.005% to 0.1% of the medium-low-temperature raw coal tar; the yield of vacuum residual oil in the products is lower than 8 w %.

Further, a preferred embodiment of the present invention is that: the hydro-refining unit adopts a naphtha hydro-refining reactor that is a fixed bed reactor, containing a loaded catalyst having olefin saturation and sulphur and nitrogen removal functions; the catalyst is a special catalyst in which two or three metals of Co, Mo, Ni and W are loaded in $Al_2O_3$; the total mass of the metals is 20% to 40% of catalyst mass; the $Al_2O_3$ is a neutral $Al_2O_3$; the total amount of the metals in the catalyst is 0.005% to 0.01% of the naphtha; the naphtha hydro-refining reactor operates under the conditions of reaction pressure 14 to 18 MPa, reaction temperature 150 to 290° C., total feed volume space velocity 0.4 to 1.5 $h^{-1}$, and hydrogenloil volume ratio 600 to 1000; the content of S in the refined product is lower than 0.5 ppm, and the content of N is lower than 0.5 ppm.

Further, a preferred embodiment of the present invention is that: the hydro-upgrading unit adopts a diesel and wax oil hydro-upgrading reactor that is a fixed bed reactor, containing a loaded catalyst having metal removal, sulphur and nitrogen removal and minor wax oil cracking functions; the catalyst is a special catalyst in which two or three metals of Co, Mo, Ni and W are loaded in $Al_2O_3$; the total mass of the metals is 20% to 40% of catalyst mass; the $Al_2O_3$ is slight acid alumina, with pH being 5 to 6; the total amount of the metals in the catalyst is 0.005% to 0.01% of the total amount of the diesel and the wax oil; the diesel and wax oil hydro-upgrading reactor operates under the conditions of reaction pressure 14 to 18 MPa., reaction temperature 240 to 400° C., total feed volume space velocity 0.3 to 1.0 $h^{-1}$, and hydrogen/oil volume ratio 800 to 1400; the content of S in the modified products is lower than 1 ppm, and the content of N is lower than 1 ppm.

Further, a preferred embodiment of the present invention is that: the hydro-cracking unit adopts a wax oil hydro-cracking reactor that is a fixed bed reactor, containing a loaded catalyst having a wax oil cracking function; the catalyst is a special catalyst in which two or three metals of Co, Mo, Ni and W are loaded in $Al_2O_3$; the total mass of the metals is 20% to 40% of catalyst mass; the $Al_2O_3$ is acidic alumina, with pH being 4.1 to 4.7; the total amount of the metals in the catalyst is 0.005% to 0.01% of the total amount of the modified wax oil; the wax oil hydro-cracking reactor operates under the conditions of reaction pressure 14 to 18 MPa, reaction temperature 360 to 390° C., total feed volume space velocity 0.3 to 1.0 $h^{-1}$, and hydrogen/oil volume ratio 800 to 1600; the yield of the cracked wax oil in the cracked products is lower than 9 w %.

Further, a preferred embodiment of the present invention is that: the gasoline and diesel precious metal hydrogenation unit adopts a gasoline and diesel precious metal hydrogenation reactor that is a fixed bed reactor, containing a loaded catalyst having aromatic saturation and isomerisation functions; the gasoline and diesel precious metal hydrogenation reactor operates under the conditions of reaction pressure 12 to 18 MPa, reaction temperature 220 to 340'C., total feed volume space velocity 0.2 to 1.0 $h^{-1}$, and hydrogen/oil volume ratio 600 to 1000.

Further, a preferred embodiment of the present invention is that: the loaded catalyst having aromatic saturation and isomerisation functions is a catalyst in which two metals Pt and Pd are loaded in $Al_2O_3$; the total mass of the metals is 0.3% to 3.5% of catalyst mass; Pt and Pd have a mass ratio of 1:0.2 to 1:1; the total amount of the metals in the catalyst is 0.005% to 0.01% of the total amount of the refined naphtha, the modified naphtha, the modified diesel, the cracked naphtha and the cracked diesel.

The present invention has the following beneficial effects.

The present invention reduces the yield of vacuum residual oil in the products by thermal hydrocracking reaction, and improves the quality of naphtha, aviation kerosene and diesel products through naphtha hydro-refining, diesel and wax oil hydro-upgrading, wax oil hydro-cracking and precious metal hydrogenation units. The method provided by the present invention can produce high-end products with high yield and high value, and has a great promotion and application prospect.

BRIEF DESCRIPTION OF THE DRAWINGS

The FIGURE is a process flow diagram of a combined hydrogenation process method of the present invention.

DETAILED DESCRIPTION OF THE PREFERRED EMBODIMENT

The present invention discloses a combined hydrogenation process method for producing high-quality fuel by medium-low-temperature coal tar. Those skilled in art may make proper changes to the process parameters for implementation with reference to the content herein. Specifically, it should be noted that the similar replacement and alteration are apparent to those skilled in art and shall be included in the present invention. The method and reference of the present invention are described in the preferred embodiments. It is obvious that relevant persons can implement and apply the method of the present invention through alteration to or proper change and combination of the method and application described herein without departing from the content, spirit and scope of the present invention.

As shown in the FIGURE, a combined hydrogenation process method for producing high-quality fuel by medium-low-temperature coal tar comprises the following steps:

step i, a medium-low-temperature coal tar, a catalyst, a fresh hydrogen and a recycle hydrogen are mixed to directly enter a thermal hydrocracking unit; after reaction in the thermal hydrocracking unit, the resulting gas product enters a pipe network, while liquid product enters a first atmospheric fractionation unit;

step ii, the liquid product is fractionated into a naphtha, a diesel and an atmospheric residual oil through the first atmospheric fractionation unit;

step iii, the naphtha, the fresh hydrogen and the recycle hydrogen are mixed to enter a naphtha hydro-refining unit; after reaction in the naphtha hydro-refining unit, the gas product enters a pipe network, while the liquid product is a refined naphtha;

step iv, atmospheric residual oil enters a vacuum fractionation unit to be fractionated into a tail oil and a wax oil; the tail oil is used to prepare a new carbon material;

step v, the diesel is first mixed with the wax oil, and then mixed with the fresh hydrogen and the recycle hydrogen, and then enters a diesel and wax oil hydro-upgrading unit; after reaction in the diesel and wax oil hydro-upgrading unit, the gas product enters a pipe network, while the liquid product enters a second atmospheric fractionation unit to be fractionated into a modified naphtha, a modified diesel fraction and a modified wax oil;

step vi, the modified wax oil is first mixed with the cracked wax oil, and then mixed with the fresh hydrogen and the recycle hydrogen, and then enters a wax oil hydro-cracking unit; after reaction in the wax oil hydro-cracking unit, the gas product enters a pipe network, while the liquid product enters a third atmospheric fractionation unit to be fractionated into a cracked naphtha, a cracked diesel fraction and a cracked wax oil fraction;

step vii, the refined naphtha is first mixed with the modified naphtha, the modified diesel, the cracked naphtha and the cracked diesel, and then mixed with the fresh hydrogen and the recycle hydrogen, and then enters a gasoline and diesel precious metal hydrogenation unit; after reaction in the gasoline and diesel precious metal hydrogenation unit, the gas product enters a pipe network, while the liquid product enters a fourth atmospheric fractionation unit to yield a final product through fractionation.

The liquid product is fractionated into a light naphtha product as a high-quality raw material for catalytic reforming, a jet fuel product as a high-density aviation kerosene, and a heavy diesel product as a high-density diesel blend component in the fourth atmospheric fractionation unit.

The liquid product is fractionated into a naphtha product as a high-quality raw material for catalytic reforming and a diesel product as a high-density low-condensation-point diesel in the fourth atmospheric fractionation unit.

The catalyst of the thermal hydrocracking unit is a molybdenum-nickel-iron trimetal compound oil soluble catalyst; the mass ratio of the molybdenum-nickel-iron trimetal compound oil soluble catalyst is 1:5:5 to 1:10:10; the thermal hydrocracking unit adopts a thermal hydrocracking reactor that is an empty tube reactor without internal components; the thermal hydrocracking reactor operates under the conditions of reaction pressure 15 to 25 MPa, reaction temperature 410 to 460° C., total feed volume space velocity 0.5 to 2.0 $h^{-1}$, and hydrogen/oil volume ratio 600 to 1400; the total amount of metals in the catalyst is 0.005% to 0.1% of the medium-low-temperature raw coal tar; the yield of vacuum residual oil in the products is lower than 8 w %.

The hydro-refining unit adopts a naphtha hydro-refining reactor that is a fixed bed reactor-containing a loaded catalyst having olefin saturation and sulphur and nitrogen removal functions; the catalyst is a special catalyst in which two or three metals of Co, Mo, Ni and W are loaded in $Al_2O_3$; the total mass of the metals is 20% to 40% of catalyst mass; the $Al_2O_3$ is a neutral $Al_2O_3$; the total amount of the metals in the catalyst is 0.005% to 0.01% of the naphtha; the naphtha hydro-refining reactor operates under the conditions of reaction pressure 14 to 18 MPa, reaction temperature 150 to 290° C., total feed volume space velocity 0.4 to 1.5 $h^{-1}$, and hydrogen/oil volume ratio 600 to 1000; the content of S in the refined products is lower than 0.5 ppm, and the content of N is lower than 0.5 ppm.

The hydro-upgrading unit adopts a diesel and wax oil hydro-upgrading reactor that is a fixed bed reactor, containing a loaded catalyst having metal removal, sulphur and nitrogen removal and minor wax oil cracking functions; the catalyst is a special catalyst in which two or three metals of Co, Mo, Ni and W are loaded in $Al_2O_3$; the total mass of the metals is 20% to 40% of catalyst mass; the $Al_2O_3$ is slight acid alumina, with pH being 5 to 6; the total amount of the metals in the catalyst is 0.005% to 0.01% of the total amount of the diesel and the wax oil: the diesel and wax oil hydro-upgrading reactor operates under the conditions of reaction pressure 14 to 18 MPa, reaction temperature 240 to 400'C., total feed volume space velocity 0.3 to 1.0 $h^{-1}$, and hydrogen/oil volume ratio 800 to 1400; the content of S in the modified products is lower than 1 ppm, and the content of N is lower than 1 ppm.

The hydro-cracking unit adopts a wax oil hydro-cracking reactor that is a fixed bed reactor, containing a loaded catalyst having a wax oil cracking function; the catalyst is a special catalyst in which two or three metals of Co, Mo, Ni and W are loaded in $Al_2O_3$; the total mass of the metals is 20% to 40% of catalyst mass; the $Al_2O_3$ is acidic alumina, with pH being 4.1 to 4.7; the total amount of the metals in the catalyst is 0.005% to 0.01% of the total amount of the modified wax oil; the wax oil hydro-cracking reactor operates under the conditions of reaction pressure 14 to 18 MPa, reaction temperature 360 to 390° C., total feed volume space velocity 0.3 to 1.0 $h^{-1}$, and hydrogen/oil volume ratio 800 to 1600; the yield of the cracked wax oil in the cracked products is lower than 9 w %.

The gasoline and diesel precious metal hydrogenation unit adopts a gasoline and diesel precious metal hydrogenation reactor that is a fixed bed reactor, containing a loaded catalyst having aromatic saturation and isomerisation functions; the gasoline and diesel precious metal hydrogenation reactor operates under the conditions of reaction pressure 12 to 18 MPa, reaction temperature 220 to 340° C., total feed volume space velocity 0.2 to 1.0 $h^{-1}$, and hydrogen/oil volume ratio 600 to 1000.

The loaded catalyst having aromatic saturation and isomerisation functions is a catalyst in which two metals Pt and Pd are loaded in $Al_2O_3$; the total mass of the metals is 0.3% to 3.5% of catalyst mass; Pt and Pd have a mass ratio of 1:0.2 to 1:1; the total amount of the metals in the catalyst is 0.005% to 0.01% of the total amount of the refined naphtha, the modified naphtha, the modified diesel, the cracked naphtha and the cracked diesel.

EXAMPLE 1

The medium-low-temperature coal tar used in Example 1 is from Inner Mongolia; the properties of the raw material are shown in Table 1.

TABLE 1

Properties of medium-low-temperature raw coal tar from Inner Mongolia

| Items | Medium-low-temperature coal tar |
|---|---|
| Density (20° C.), g · cm$^{-3}$ | 1.0990 |
| Water content, w % | 1.75 |
| C content, w % | 80.93 |
| H content, w % | 8.11 |
| S content, w % | 0.58 |
| N content, w % | 1.13 |
| Carbon residue, w % | 7.50 |
| Asphaltene, w % | 32.38 |
| Toluene insoluble, w % | 6.50 |

A pilot test is carried out for the medium-low-temperature coal tar according to the following operating conditions of:

thermal hydrocracking reaction temperature 410'C, reaction pressure 15.0 MPa, hydrogen/oil ratio 1400:1, fresh raw material space velocity 0.5 h$^{-1}$, molybdenum-nickel-iron mass ratio of the catalyst: 1:5:5, and total metal amount of the catalyst: 0.005% of raw material;

naphtha hydro-refining average reaction temperature 290° C., reactor outlet total pressure 18.0 MPa, hydrogen/oil ratio 1000:1, feed space velocity 1.5 h$^{-1}$; wherein, the catalyst is a loaded catalyst having metal removal, sulphur and nitrogen removal and minor wax oil cracking functions; it is a special catalyst in which Co, Mo and Ni are loaded in $Al_2O_3$ and have a mass ratio of 1:1:1; the total mass of the metals is 20% of catalyst mass; the $Al_2O_3$ is a neutral alumina; the total amount of the metals in the catalyst is 0.01% of the total amount of the diesel and the wax oil;

diesel and wax oil hydro-upgrading average reaction temperature 240° C., reactor outlet total pressure 18.0 MPa, hydrogen/oil ratio 800:1, feed space velocity 0.3 h$^{-1}$; wherein, the catalyst is a catalyst in which Co, Mo and W are loaded in $Al_2O_3$ and have a mass ratio of 1:2:2; the total mass of the metals is 20% of catalyst mass; the $Al_2O_3$ is a slight acid alumina, with pH being 5 to 6; the total amount of the metals in the catalyst is 0.01% of the total amount of the diesel and the wax oil;

wax oil hydro-cracking average reaction temperature 360° C., reactor outlet total pressure 14.0 MPa, hydrogen/oil ratio 800:1, feed space velocity 0.3 h$^{-1}$; wherein, the catalyst is a loaded catalyst having a wax oil cracking function; it is a catalyst in which Co, Mo and Ni are loaded in $Al_2O_3$ and have a mass ratio of 1:1:1; the total mass of the metals is 20% of catalyst mass; the $Al_2O_3$ is an acidic alumina, with pH being 4.1 to 4.7; the total amount of the metals in the catalyst is 0.01% of the total amount of the modified wax oil;

gasoline and diesel precious metal hydrogenation average reaction temperature 220° C., reactor outlet total pressure 12.0 MPa, hydrogen/oil ratio 600:1, feed space velocity 0.2 h$^{-1}$; wherein, the catalyst is a loaded catalyst having aromatic saturation and isomerisation functions; it is a catalyst in which two metals Pt and Pd are loaded in $Al_2O_3$; the total mass of the metals is 0.3% of catalyst mass; Pt and Pd have a mass ratio of 1:0.2; the total amount of the metals in the catalyst is 0.01% of the total amount of the modified naphtha, the modified diesel, the cracked naphtha and the cracked diesel.

The liquid product is fractionated into a light naphtha product ((IBP~140° C. fraction) as a high-quality raw material for catalytic reforming, a jet fuel product (140~300° C. fraction) as a high-density aviation kerosene, and a heavy diesel product (>300° C. fraction) as a high-density diesel blend component in the fourth atmospheric fractionation unit. Material balance results of Example 1 are shown in Table 2; the properties of the main products obtained are shown in Table 3 to Table 5.

TABLE 2

Hydrogenation material balance results of medium-low-temperature coal tar from Inner Mongolia Product Distribution (of fresh raw material), w %

| | Name of Feed and Discharge | Coal tar |
|---|---|---|
| Feed | Whole fraction of coal tar | 100 |
| | Hydrogen consumption | 9.26 |
| | Total feed | 109.26 |
| Discharge | Gas | 19.14 |
| | Water | 8.22 |
| | Naphtha | 15.29 |
| | Jet fuel | 38.85 |
| | Heavy diesel | 27.79 |
| | Total discharge | 109.26 |

TABLE 3

Properties of light naphtha product (IBP-140° C.)

| Analysis Items | Light naphtha |
|---|---|
| Density (20° C.)/g · cm$^{-3}$ | 0.7693 |
| S/μg · g$^{-1}$ | <0.1 |
| N/μg · g$^{-1}$ | <0.1 |
| Potential aromatic content | 76.8 |

TABLE 4

Properties of aviation kerosene product (140-280° C.)

| Analysis Items | Aviation kerosene component |
|---|---|
| Density (20° C.)/g · cm$^{-3}$ | 0.8558 |
| Freezing point/° C. | −60 |
| S/μg · g$^{-1}$ | 3 |
| N/μg · g$^{-1}$ | 5 |
| Copper strip corrosion (100° C., 2H)/level | 1a |
| Silver strip corrosion (50° C., 4H)/level | / |
| Net heating value/MJ · (kg)$^{-1}$ | 43.05 |
| Smoke point/mm | 26.2 |
| Naphthalene aromatic content/w % (smoke point <20 mm) | 0.15 |
| Existent gum/mg (100 ml)$^{-1}$ | 0.3 |

TABLE 5

| Properties of heavy diesel product (280-370° C.) | |
|---|---|
| Analysis Items | Diesel component |
| Density (20° C.)/g · cm$^{-3}$ | 0.9501 |
| Condensation point/° C. | −43 |
| C/w % | 87.66 |
| H/w % | 12.13 |
| S/μg · g$^{-1}$ | 7.2 |
| N/μg · g$^{-1}$ | 9.0 |

EXAMPLE 2

The medium-low-temperature coal tar used in Example 2 is from Shaanxi; the properties of the raw material are shown in Table 6.

TABLE 6

| Properties of medium-low-temperature raw coal tar from Shaanxi | |
|---|---|
| Items | Medium-low-temperature coal tar |
| Density (20° C.), g · cm$^{-3}$ | 1.0753 |
| Water content, w % | 1.26 |
| C content, w % | 80.42 |
| H content, w % | 8.60 |
| S content, w % | 0.39 |
| N content, w % | 0.97 |
| Carbon residue, w % | 11.81 |
| Asphaltene, w % | 28.64 |
| Toluene insoluble, w % | 5.25 |

A pilot test is carried out for the medium-low-temperature coal tar according to the following operating conditions of:

thermal hydrocracking reaction temperature 460° C., reaction pressure 25.0 MPa, hydrogen/oil ratio 600:1, fresh raw material space velocity 2.0 h$^{-1}$, molybdenum-nickel-iron mass ratio of the catalyst: 1:10:10, and total metal amount of the catalyst: 0.1% of raw material;

naphtha hydro-refining average reaction temperature 150° C., reactor outlet total pressure 14.0 MPa, hydrogen/oil ratio 600:1, feed space velocity 0.4 h$^{-1}$; wherein, the catalyst is a loaded catalyst having metal removal, sulphur and nitrogen removal and minor wax oil cracking functions; it is a special catalyst in which Mo and W are loaded in $Al_2O_3$ and have a mass ratio of 1:1; the total mass of the metals is 40% of catalyst mass; the $Al_2O_3$ is a neutral alumina; the total amount of the metals in the catalyst is 0.005% of the total amount of the diesel and the wax oil;

diesel and wax oil hydro-upgrading average reaction temperature 400° C., reactor outlet total pressure 14.0 MPa, hydrogen/oil ratio 1400:1, feed space velocity 1.0 h$^{-1}$; wherein, the catalyst is a catalyst in which Mo and Ni are loaded in $Al_2O_3$; the total mass of the metals is 40% of catalyst mass; the $Al_2O_3$ is a slight acid alumina, with pH being 5 to 6; the total amount of the metals in the catalyst is 0.005% of the total amount of the diesel and the wax oil;

wax oil hydro-cracking average reaction temperature 390° C., reactor outlet total pressure 18.0 MPa, hydrogen/oil ratio 1600:1, feed space velocity 1.0 j$^{-1}$; wherein, the catalyst is a loaded catalyst having a wax oil cracking function; it is a catalyst in which Ni and W are loaded in $Al_2O_3$ and have a mass ratio of 1:1; the total mass of the metals is 40% of catalyst mass; the $Al_2O_3$ is an acidic alumina, with pH being 4.1 to 4.7; the total amount of the metals in the catalyst is 0.005% of the total amount of the modified wax oil;

gasoline and diesel precious metal hydrogenation average reaction temperature 340° C., reactor outlet total pressure 18.0 MPa, hydrogen/oil ratio 1000:1, feed space velocity 1.0 h$^{-1}$; wherein, the catalyst is a loaded catalyst having aromatic saturation and isomerisation functions; it is a catalyst in which two metals Pt and Pd are loaded in $Al_2O_3$; the total mass of the metals is 3.5% of catalyst mass; Pt and Pd have a mass ratio of 1:1; the total amount of the metals in the catalyst is 0.005% of the total amount of the modified naphtha, the modified diesel, the cracked naphtha and the cracked diesel.

The liquid product is fractionated into a naphtha product (IBP~180° C. fraction) as a high-quality raw material for catalytic reforming and a diesel product as a high-density low-condensation-point diesel (180° C. fraction) in the fourth atmospheric fractionation unit.

Material balance results of Example 2 are shown in Table 7; the properties of the main products obtained are shown in Table 8 to Table 9.

TABLE 7

| Hydrogenation material balance results of medium-low-temperature coal tar from Shaanxi<br>Product Distribution (of fresh raw material), w % | | |
|---|---|---|
| | Name of Feed and Discharge | Coal tar |
| Feed | Whole fraction of coal tar | 100 |
| | Hydrogen consumption | 9.05 |
| | Total feed | 109.05 |
| Discharge | Gas | 19.28 |
| | Water | 7.96 |
| | Naphtha | 24.36 |
| | Diesel | 57.45 |
| | Total discharge | 109.05 |

TABLE 8

| Properties of naphtha product (IBP-180° C.) | |
|---|---|
| Analysis Items | Naphtha |
| Density (20° C.)/g · cm$^{-3}$ | 0.7932 |
| S/μg · g$^{-1}$ | 1.1 |
| N/μg · g$^{-1}$ | 1.6 |
| Potential aromatic content | 76.8 |

TABLE 9

| Properties of diesel product (180-370° C.) | |
|---|---|
| Analysis Items | Diesel component |
| Density (20° C.)/g · cm$^{-3}$ | 0.9026 |
| Condensation point/° C. | −67.0 |
| C/w % | 87.66 |
| H/w % | 12.13 |
| S/μg · g$^{-1}$ | 4.3 |
| N/μg · g$^{-1}$ | 6.2 |

EXAMPLE 3

The same as Example 1, the medium-low-temperature coal tar used in Example 3 is from Inner Mongolia; the properties of the raw material are shown in Table 1.

A pilot test is carried out for the medium-low-temperature coal tar according to the following operating conditions of:

thermal hydrocracking reaction temperature 430° C., reaction pressure 20.0 MPa, hydrogen/oil ratio 1000:1, fresh raw material space velocity 1.0 $h^{-1}$, molybdenum-nickel-iron mass ratio of the catalyst: 1:7:6, and total metal amount of the catalyst: 0.010% of raw material;

naphtha hydro-refining average reaction temperature 230° C., reactor outlet total pressure 16.0 MPa, hydrogen/oil ratio 800:1, feed space velocity 1.0 $h^{-1}$; wherein, the catalyst is a loaded catalyst having metal removal, sulphur and nitrogen removal and minor wax oil cracking functions; it is a special catalyst in which Co, Mo and W are loaded in $Al_2O_3$ and have a mass ratio of 1:2:3; the total mass of the metals is 30% of catalyst mass; the $Al_2O_3$ a is neutral alumina; the total amount of the metals in the catalyst is 0.008% of the total amount of the diesel and the wax oil;

diesel and wax oil hydro-upgrading average reaction temperature 320° C., reactor outlet total pressure 16.0 MPa, hydrogen/oil ratio 1200:1, feed space velocity 0.8 $h^{-1}$; wherein, the catalyst is a catalyst in which Mo, Ni and W are loaded in $Al_2O_3$ and have a mass ratio of 1:1:2; the total mass of the metals is 28% of catalyst mass; the $Al_2O_3$ is a slight acid alumina, with pH being 5 to 6; the total amount of the metals in the catalyst is 0.006% of the total amount of the diesel and the wax oil;

wax oil hydro-cracking average reaction temperature 370° C., reactor outlet total pressure 16.0 MPa, hydrogen/oil ratio 1200:1, feed space velocity 0.7 $h^{-1}$; wherein, the catalyst is a loaded catalyst having a wax oil cracking function; it is a catalyst in which Co, Mo and Ni are loaded in $Al_2O_3$ and have a mass ratio of 1:4:4; the total mass of the metals is 30% of catalyst mass; the $Al_2O_3$ is an acidic alumina, with pH being 4.1 to 4.7; the total amount of the metals in the catalyst is 0.007% of the total amount of the modified wax oil;

gasoline and diesel precious metal hydrogenation average reaction temperature 280° C., reactor outlet total pressure 16.0 MPa, hydrogen/oil ratio 800:1, feed space velocity 0.7 $h^{-1}$; wherein, the catalyst is a loaded catalyst having aromatic saturation and isomerisation functions; it is a catalyst in which two metals Pt and Pd are loaded in $Al_2O_3$ the total mass of the metals is 2.5% of catalyst mass; Pt and Pd have a mass ratio of 1:0.6; the total amount of the metals in the catalyst is 0.007% of the total amount of the modified naphtha, the modified diesel, the cracked naphtha and the cracked diesel.

The liquid product is fractionated into a light naphtha product (IBP~140° C. fraction) as a high-quality raw material for catalytic reforming, a jet fuel product (140~300° C. fraction) as a high-density aviation kerosene, and a heavy diesel product (>300° C. fraction) as a high-density diesel blend component in the fourth atmospheric fractionation unit.

Material balance results of Example 3 are shown in Table 10; the properties of the main products obtained are shown in Table 11 to Table 13.

TABLE 10

Hydrogenation material balance results of medium-low-temperature coal tar from Inner Mongolia
Product Distribution (of fresh raw material), w %

| | Name of Feed and Discharge | Coal tar |
|---|---|---|
| Feed | Whole fraction of coal tar | 100 |
| | Hydrogen consumption | 8.52 |
| | Total feed | 108.52 |
| Discharge | Gas | 18.96 |
| | Water | 8.10 |
| | Naphtha | 15.13 |
| | Jet fuel | 38.66 |
| | Heavy diesel | 20.70 |
| | Total discharge | 108.52 |

TABLE 11

Properties of light naphtha product (IBP-140° C.)

| Analysis Items | Light naphtha |
|---|---|
| Density (20° C.)/g · $cm^{-3}$ | 0.7685 |
| S/μg · $g^{-1}$ | <0.1 |
| N/μg · $g^{-1}$ | <0.1 |
| Potential aromatic content | 76.3 |

TABLE 12

Properties of aviation kerosene product (140-280° C.)

| Analysis Items | Jet fuel component |
|---|---|
| Density (20° C.)/g · $cm^{-3}$ | 0.8562 |
| Freezing point/° C. | −60 |
| S/μg · $g^{-1}$ | 3 |
| Nμg · $g^{-1}$ | 5 |
| Copper strip corrosion (100° C., 2H)/level | 1a |
| Silver strip corrosion (50° C., 4H)/level | / |
| Net heating value/MJ · $(kg)^{-1}$ | 43.08 |
| Smoke point/mm | 26.1 |
| Naphthalene aromatic content/w % (smoke point<20 mm) | 0.13 |
| Existent gum/mg (100 ml)$^{-1}$ | 0.29 |

TABLE 13

Properties of heavy diesel product (280-370° C.)

| Analysis Items | Diesel component |
|---|---|
| Density (20° C.)/g · $cm^{-3}$ | 0.9503 |
| Condensation point/° C. | −44 |
| C/w % | 87.61 |
| H/w % | 12.06 |
| S/μg · $g^{-1}$ | 7.2 |
| N/μg · $g^{-1}$ | 9.0 |

The above description of the disclosed embodiments may help those skilled in art implement or apply the present invention. Various modifications made to the embodiments are apparent to those skilled in art. General principles defined herein may be implemented in other embodiments without departing from the spirit or scope of the present invention. Therefore, the present invention will not be limited to the embodiments described herein, but in conformity with a broadest scope that is consistent with the principles and novelty features disclosed herein.

The invention claimed is:

1. A combined hydrogenation processing method for producing fuel production by medium-low-temperature coal tar, comprising the following steps:

step i, mixing a medium-low-temperature coal tar, a catalyst, a fresh hydrogen and a recycle hydrogen and directly entering a thermal hydrocracking unit; after reaction in the thermal hydrocracking unit, making a gas product in the reaction in the thermal hydrocracking unit enter a pipe network, while a liquid product in the reaction in the thermal hydrocracking unit enters a first atmospheric fractionation unit;

step ii, fractionating the liquid product in the reaction in the thermal hydrocracking unit into a naphtha, a diesel and an atmospheric residual oil through the first atmospheric fractionation unit;

step iii, mixing the naphtha, the fresh hydrogen and the recycle hydrogen and entering a naphtha hydro-refining unit; after reaction in the naphtha hydro-refining unit, making a gas product in the reaction in the naphtha hydro-refining unit enter the pipe network, while a liquid product in the reaction in the naphtha hydro-refining unit is a refined naphtha;

step iv, making atmospheric residual oil enter a vacuum fractionation unit, and fractionating atmospheric residual oil into a tail oil and a wax oil through the vacuum fractionation; the tail oil is used to prepare a new carbon material;

step v, mixing the diesel with the wax oil, and then mixing with the fresh hydrogen and the recycle hydrogen, and then entering a diesel and wax oil hydro-upgrading unit; after reaction in the diesel and wax oil hydro-upgrading unit, making a gas product in the reaction in the diesel and wax oil hydro-upgrading unit enter the pipe network, while a liquid product in the reaction in the diesel and wax oil hydro-upgrading unit enter a second atmospheric fractionation unit, and fractionating the liquid product in the reaction in the diesel and wax oil hydro-upgrading unit into a modified naphtha, a modified diesel and a modified wax oil in the second atmospheric fractionation unit;

step vi, mixing the modified wax oil with a cracked wax oil, and then mixing with the fresh hydrogen and the recycle hydrogen, and then entering a wax oil hydro-cracking unit; after reaction in the wax oil hydro-cracking unit, making a gas product in the reaction in the wax oil hydro-cracking unit enter the pipe network, while a liquid product in the reaction in the wax oil hydro-cracking unit enter a third atmospheric fractionation unit, and fractionating the liquid product in the reaction in the wax oil hydro-cracking unit into a cracked naphtha, a cracked diesel and the cracked wax oil in the third atmospheric fractionation unit;

step vii, mixing the refined naphtha with the modified naphtha, the modified diesel, the cracked naphtha and the cracked diesel, and then mixing with the fresh hydrogen and the recycle hydrogen, and then entering a gasoline and diesel precious metal hydrogenation unit;

after reaction in the gasoline and diesel precious metal hydrogenation unit, making a gas product in the reaction in the gasoline and diesel precious metal hydrogenation unit enter the pipe network, while a liquid product in the reaction in the gasoline and diesel precious metal hydrogenation unit enter a fourth atmospheric fractionation unit, and fractionating the liquid product in the reaction in the gasoline and diesel precious metal hydrogenation unit in the fourth atmospheric fractionation unit to yield a final product.

2. The combined hydrogenation processing method according to claim 1, wherein the liquid product is fractionated into a light naphtha product as a raw material for catalytic reforming, a jet fuel product as an aviation kerosene, and a heavy diesel product as a diesel blend component in the fourth atmospheric fractionation unit.

3. The combined hydrogenation processing method according to claim 1, wherein the liquid product is fractionated into a naphtha product as a raw material for catalytic reforming and a diesel product as a low condensation-point diesel in the fourth atmospheric fractionation unit.

4. The combined hydrogenation processing method according to claim 1, wherein the catalyst of the thermal hydrocracking unit is a molybdenum-nickel-iron trimetal compound oil soluble catalyst; the mass ratio of the molybdenum-nickel-iron trimetal compound oil soluble catalyst is 1:5:5 to 1:10:10; the thermal hydrocracking unit adopts a thermal hydrocracking reactor that is an empty tube reactor without internal components; the thermal hydrocracking reactor operates under the conditions of reaction pressure 15 to 25 MPa, reaction temperature 410 to 460° C., total feed volume space velocity 0.5 to 2.0$h^{-1}$, and hydrogen/oil volume ratio 600 to 1400; the total amount of metals in the catalyst is 0.005% to 0.1% of the medium-low-temperature raw coal tar; the yield of vacuum residual oil in the products is lower than 8 w %.

5. The combined hydrogenation processing method according to claim 1, wherein the hydro-refining unit adopts a naphtha hydro-refining reactor that is a fixed bed reactor, containing a loaded catalyst having olefin saturation and sulphur and nitrogen removal functions; the catalyst is a special catalyst in which two or three metals of Co, Mo, Ni and W are loaded in $Al_2O_3$; the total mass of the metals is 20% to 40% of catalyst mass; the $Al_2O_3$ is a neutral $Al_2O_3$; the total amount of the metals in the catalyst is 0.005% to 0.01% of the naphtha; the naphtha hydro-refining reactor operates under the conditions of reaction pressure 14 to 18 MPa, reaction temperature 150 to 290° C., total feed volume space velocity 0.4 to 1.5 $h^{-1}$, and hydrogen/oil volume ratio 600 to 1000; the content of S in the refined products is lower than 0.5 ppm, and the content of N is lower than 0.5 ppm.

6. The combined hydrogenation processing method according to claim 1, wherein the hydro-upgrading unit adopts a diesel and wax oil hydro-upgrading reactor that is a fixed bed reactor, containing a loaded catalyst having metal removal, sulphur and nitrogen removal and minor wax oil cracking functions; the catalyst is a special catalyst in which two or three metals of Co, Mo, Ni and W are loaded in $Al_2O_3$; the total mass of the metals is 20% to 40% of catalyst mass; the $Al_2O_3$ is slight acid alumina, with pH being 5 to 6; the total amount of the metals in the catalyst is 0.005% to 0.01% of the total amount of the diesel and the wax oil; the diesel and wax oil hydro-upgrading reactor operates under the conditions of reaction pressure 14 to 18 MPa, reaction temperature 240 to 400° C., total feed volume space velocity 0.3 to 1.0 $h^{-1}$, and hydrogen/oil volume ratio 800 to 1400; the content of S in the modified products is lower than 1 ppm, and the content of N is lower than 1 ppm.

7. The combined hydrogenation processing method according to claim 1, wherein the hydro-cracking unit adopts a wax oil hydro-cracking reactor that is a fixed bed reactor, containing a loaded catalyst having a wax oil cracking function; the catalyst is a special catalyst in which two or three metals of Co, Mo, Ni and W are loaded in $Al_2O_3$; the total mass of the metals is 20% to 40% of catalyst mass; the $Al_2O_3$ is acidic alumina, with pH being 4.1 to 4.7; the total amount of the metals in the catalyst is 0.005% to 0.01% of the total amount of the modified wax oil; the wax oil hydro-cracking reactor operates under the conditions of reaction pressure 14 to 18 MPa, reaction temperature 360 to 390° C., total feed volume space velocity 0.3 to 1.0 $h^{-1}$, and hydrogen/oil volume ratio 800 to 1600; the yield of the cracked wax oil in the cracked products is lower than 9 w %.

8. The combined hydrogenation processing method according to claim 1, wherein the gasoline and diesel precious metal hydrogenation unit adopts a gasoline and diesel precious metal hydrogenation reactor that is a fixed bed reactor, containing a loaded catalyst having aromatic saturation and isomerisation functions; the gasoline and diesel precious metal hydrogenation reactor operates under the conditions of reaction pressure 12 to 18 MPa, reaction temperature 220 to 340° C., total feed volume space velocity 0.2 to 1.0 $h^{-1}$, and hydrogen/oil volume ratio 600 to 1000.

9. The combined hydrogenation processing method according to claim 1, wherein the loaded catalyst having aromatic saturation and isomerisation functions is a catalyst in which two metals Pt and Pd are loaded in $Al_2O_3$; the total mass of the metals is 0.3% to 0.5% of catalyst mass; Pt and Pd have a mass ratio of 1:0.2 to 1:1; the total amount of the metals in the catalyst is 0.005% to 0.01% of the total amount of the refined naphtha, the modified naphtha, the modified diesel, the cracked naphtha and the cracked diesel.

* * * * *